United States Patent [19]

Massarsch

[11] Patent Number: 4,699,546

[45] Date of Patent: Oct. 13, 1987

[54] METHOD AND APPARATUS FOR COMPACTING A SOIL STRATUM USING VIBRATIONS

[75] Inventor: Karl R. Massarsch, La Hulpe, Belgium

[73] Assignee: S.A. Compagnie Internationale, Liege, Belgium

[21] Appl. No.: 885,575

[22] PCT Filed: Nov. 8, 1985

[86] PCT No.: PCT/SE85/00448

§ 371 Date: Jul. 3, 1986

§ 102(e) Date: Jul. 3, 1986

[87] PCT Pub. No.: WO86/02964

PCT Pub. Date: May 22, 1986

[30] Foreign Application Priority Data

Nov. 12, 1984 [SE] Sweden ..... 8405657

[51] Int. Cl.[4] ..... E02D 3/02

[52] U.S. Cl. ..... 405/271; 404/133; 405/258

[58] Field of Search ..... 405/271, 258, 303, 232; 404/133; 173/49; 175/56

[56] References Cited

U.S. PATENT DOCUMENTS

| | | | |
|---|---|---|---|
| 3,162,102 | 12/1964 | Juneau | 404/133 |
| 3,282,055 | 11/1966 | Landau | 405/271 |
| 3,309,877 | 3/1967 | Degen | 405/271 |
| 3,865,501 | 2/1975 | Kniep | 405/271 X |
| 4,186,197 | 1/1980 | Tetsuo | 404/133 |
| 4,397,590 | 8/1983 | Friesen et al. | 405/271 |
| 4,504,176 | 3/1985 | Lindberg et al. | 405/271 |

FOREIGN PATENT DOCUMENTS

| | | | |
|---|---|---|---|
| 157588 | 12/1939 | Fed. Rep. of Germany | 405/271 |
| 1081277 | 3/1984 | U.S.S.R. | 405/271 |

*Primary Examiner*—Dennis L. Taylor

[57] ABSTRACT

The present invention relates to a method and apparatus for compacting by vibrations a soil stratum with the aid of at least one vibration-transferring member (2) which may be driven into the soil stratum, said member transferring vibrations from a vibration generating means (1) to the soil stratum. In accordance with the invention the axial extension of the member (2) is variable both before and in conjunction with the vibration compaction by the member being implemented such as to be resilient, elastic or flexible.

18 Claims, 5 Drawing Figures

METHOD AND APPARATUS FOR COMPACTING A SOIL STRATUM USING VIBRATIONS

Figure 1:
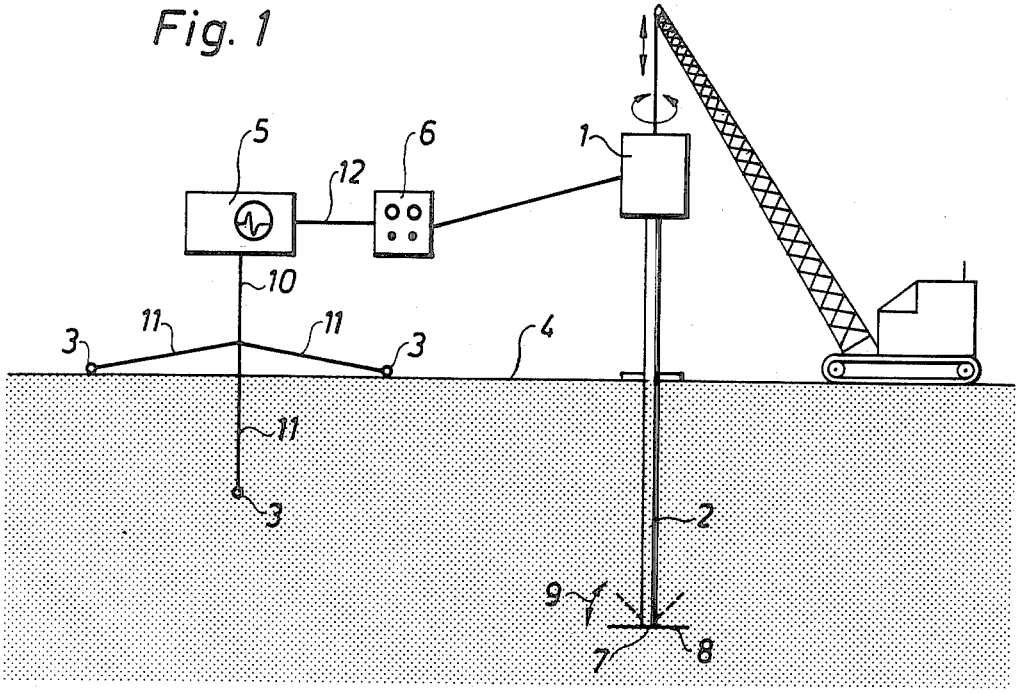

The present invention relates to a method and apparatus for deep compacting soil, and preferably such a method and apparatus for compacting soil at its natural frequency or one of its overtones.

In a method generally known today for deep compacting of soil strata there is used a rod or pipe, which is several meters long and over its entire length provided with one or a plurality of radially projecting fins or brackets. The arrangement is driven down as a unit into the soil stratum. A vibrator is mounted at the upper end of the rod with the aid of a crane or the like. The vibrator operates at constant frequency, usually around 20 Hz, a certain compaction taking place of a region having the shape cover a cone with its apex downwards and concentric with the rod and fins, as these cause the soil to accompany them in their movement.

The disadvantages with the known method and apparatus, which is still known under the designation "vibrowing method" are that compaction proceeds relatively slowly, that the effective surface over which the vibrations are propagated is small, in turn resulting in that the volume of compacted material will be limited to the extent of the fins, that the rods or pipes must be arranged close to each other with a spacing of approximately 1,5–2 meters, that compaction takes place at a constant frequency demanded by the vibrators available on the market today and which do not take into account the special properties of the soil stratum, and in that it may be difficult to withdraw the rod or pipe from the soil after compaction, because the compacted is terminated stratum effectively locks the radially projecting fins. Since large volumes of soil, e.g. sand or silt, are to be compacted, it is important that the number of compaction means be kept to a minimum, i.e. the spacing of the rods or pipes driven into the ground should be as large as possible without deteriorated compaction resulting, and that the compaction time should be as short as possible. Furthermore, the apparatus should be implemented so that the compaction means can easily be withdrawn from the soil stratum.

The DE-A-No. 27 27 880 describes an apparatus for compaction of a soil stratum at the natural frequency thereof. As with the apparatus already described, this apparatus includes a pipe which can be driven into the ground. A vibrator is mounted on the upper end of the pipe, on the surface of which are arranged axially extending fins. The vibrator is connected to the pipe at a certain angle in relation to the longitudinal axis of the pipe and/or eccentrically to this axis, the tube thus being given a radial, oscillating deflection during operation. Compaction thus takes place by the radial deflection of the pipe and not, as is the case with the present invention, by combined movements in the axial direction of the pipe. Since the pipe of the known apparatus is provided with axially distributed radially extending fins a stiffening of the pipe is obtained which contributes to the deterioration of the compacting properties thereof.

In the method and apparatus in accordance with the invention the above mentioned disadvantages are mitigated, while compaction is made more efficient. According to the invention, compaction of soil strata takes place with the aid of a rod or pipe (hereinafter designated "bar") driven into the ground, the bar varying in its axial extension both before and in conjunction with the compaction operation. It is preferable to oscillate the bar by a vibrator at the natural frequency of the earth stratum or at one of its overtones, thus providing the most effective compaction result. The axial stiffness of the bar can thus be adjusted so that it is favourably suited to the stiffness of the soil stratum. When the bar oscillates at the natural frequency of the soil stratum, the soil will also begin to oscillate at its natural frequency while using low vibration energy, without fins or brackets being needed along the bar to grip and cause the soil to accompany the movements thereof. The vibrations will propagate themselves through a larger region at the same time. According to certain calculations, the soil will oscillate at a distance of up to 10 meters from the centre of the bar. The natural frequency of a soil stratum can be calculated from the formula:

$$f=(C/4\times H)$$

where C is the wave velocity of the material in meters per second and H is the total depth of the soil stratum.

In a simple calculation example it may be assumed that a soil stratum of 10 meters consists solely of water-saturated sand, which is to be compacted. In this case the wave velocity of the material is approximately 1500 meters per second. This gives a natural frequency of 37,5 Hz. Accordingly, the vibrator should oscillate in an initial phase at about 37,5 Hz, or a frequency corresponding to an overtone thereof, for the most effective compaction result. If compaction is carried out at the lowest natural frequency of the soil stratum, assuming that it is not homogenous, it only has one oscillation node. By increasing the compaction frequency to one of the overtones of the soil stratum there will be more oscillation nodes, whereby the compaction process can be made more efficient. The structure of soil strata can be complex, however, and in practice a soil stratum does not generally consist of a single homogenous layer, but of a mixture of different layers, e.g. sand, clay, gravel etc. This means that the wave velocity of the stratum will vary during compaction, which may also be the case even for one that is homogenous. It is therefore of importance that the compaction frequency can be varied continuously to suit varying wave velocities, thus obtaining the optimum compaction frequency.

By the statement that the bar is variable in its axial extension simultaneously as it is subjected to vibrations there is intended in the following that the bar may be either telescopically or resiliently implemented. By resilient implementation is intended, for example, that the material in the bar is elastic or that the bar is formed helically so that it functions as a spring which may be compressed or extended. Bars with combinations of the mentioned properties are also conceivable within the scope of the present invention. Thus, the axial variation of a bar, i.e. its mobility in this direction, may be realized in a plurality of different ways. For example, the bar may be formed as a pipe made from a material with great resilience. The axial flexibility of such a pipe can be further improved by providing the pipe with a plurality of holes or openings along its cylindrical surface. Alternatively, the bar may be telescopically implemented or comprise a plurality of mutually coupled resilient tubular sections, which may be in mutual communication via a resilient material layer. It is also possible to form the bar as a helix. If the bar is made hollow, it can also function as a liquid conduit, particularly if its cylindrical surface is provided with a plurality of through openings. In this way a liquid can be led in any direction through the bar.

The characterizing features of the invention are apparent from the accompanying claims.

Figure 3:
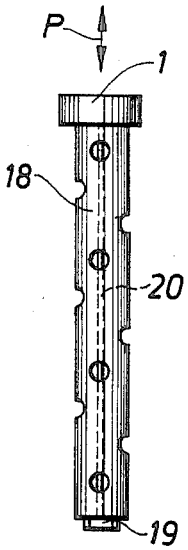

The invention will now be described in more detail in connection with the accompanying drawings, on which FIG. 1 schematically illustrates an embodiment of the apparatus, FIGS. *2a–c* illustrate three alternative embodiments of bars which are variable in their axial extension, and FIG. 3 is a further embodiment of a bar in accordance with the invention.

For operating at the optimum compaction frequency of the soil stratum during the entire procedure, i.e. at its natural frequency or one of its overtones, the apparatus includes a vibrator 1 with a variable frequency, mounted on a bar 2, driven into the soil stratum. One or more sensors 3 are arranged in the area about the bar, on or under the ground surface 4. The sensors continuously monitor the oscillation amplitude of the ground. An analyzer 5, which is in communication with the sensors via lines 10,11, analyzes the frequency content of the signals from the sensors. With the aid of the analyzer the natural frequency of the earth stratum, or one of its overtones may be continuously determined. In its turn the analyzer is connected via the line 12 to a vibrator control means 6, controlling the frequency and amplitude of the vibrator 1.

Since the inventive bar lacks the previously used radial fins or brackets distributed along the entire length of the bar, it may be implemented so that it is variable axially, e.g. it is axially resilient, which contributes to a considerable increase in the efficiency with which the soil stratum is compacted. The withdrawal of the bar from the stratum after it has been compacted is facilitated at the same time, since no fins brake the withdrawal movement. If compaction also takes place such that the frequency of the vibrator 1 is adjusted to the natural frequency of the soil stratum during the entire compaction process, this frequency being calculated by the analyzer 5 from the signals of the sensors 3, there is obtained a further increase in the effectiveness of the compaction of the stratum by the bar 2 driven into the ground. The compaction frequency of the bar will thus change in response to the varying dynamic properties of the soil. To facilitate initiation of compaction the bar 2 may be provided at its downward end 7, or in the vicinity thereof with pivotably attached radial rods 8, which, as indicated by the double arrow 9, lie retracted against the surface of the bar when it is driven into the ground and during vibration open out in a radial direction with respect to the longitudinal axis of the bar, and are released from the bar to remain in the soil when the bar is withdrawn.

Three alternative embodiments are illustrated in FIGS. *2a–c* of bars which are available in their axial extension, and with which the method in accordance with the invention is realized. In FIG. *2a* there is illustrated a pipe 13 connected to a vibrator 1, which transfers vibrations to the pipe in the direction of the double arrow P. The pipe illustrated in the example is provided with a plurality of through holes or openings 14, which further increase the resilient properties of the pipe. With the aid of the pipe bore and the openings 14, liquid can be led in any direction. During driving down the pipe 13 into the ground, liquid can thus be taken into the pipe and flushed out through the openings 14, which contributes to more rapid driving of the pipe into the ground. When the pipe has been driven to a desired level and the vibrator 1 is started, the pipe then varying its axial length due to its resilient properties during the vibrations, there is obtained a very effective compaction of the soil stratum at a considerable distance from the pipe. By "varying" there is intended here that the length of the pipe increases and decreases in relation to the length the pipe has in an unloaded i.e. unvibrated state. In the case of water-saturated soil, and in other cases as well, it is necessary to lead water away from the region being compacted, if compaction is to be successful. This can be done simply by the holed pipe also functioning as a drain. If an increased liquid content is required in one or more soil strata, liquid or a liquid mixed with another material such as lime, cement or polyurethane may also be injected into the soil via the pipe in question.

In FIG. *2b* there is illustrated a helically formed bar 15, this also being connected to a vibrator 1 at its upper end. Due to its helical implementation the bar 15 has considerably greater resilient properties in its axial direction than other bars, and it can also be made as a pipe with openings similar to those in FIG. *2a* for draining and/or injecting liquid.

A third embodiment of an inventive bar is illustrated in FIG. *2c*, this bar also being axially variable during vibration compaction. In this example the bar comprises a plurality of sections 16*a,b,c,d* coupled to each other. Four sections are illustrated in the Figure but of course more or less sections can be coupled to each other. This bar can be provided with holes along certain or all the participating sections for draining and/or injecting liquid. To increase the resilient properties of the bar, elastic spacers 17 can be arranged between respective sections. Apart from the illustrated examples, it is of course conceivable within the scope of the invention to form the apparatus telescopically extendable.

Figure 2A:
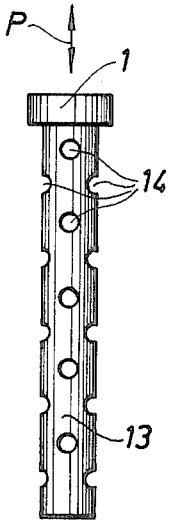
Figure 2B:
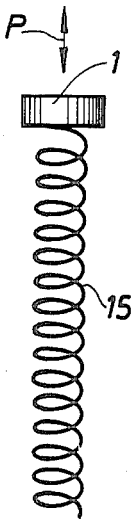
Figure 2C:
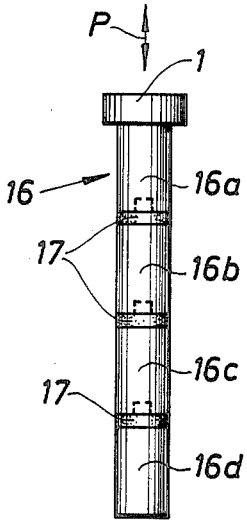

In FIG. 3 a pipe 18 similar to the pipe 13 illustrated in FIG. 2 has been provided with a stamping means 19 connected to the lower part of the pipe, the task of this means being to facilitate driving and withdrawing the pipe from the soil stratum. The stamping means 19 can be connected to a rod 20 co-axially arranged in the pipe. Without the stamping means 19 it may be difficult to withdraw a resilient or substantially flexible pipe from the ground. With the aid of the rod 20 and means 19 this withdrawal is thus greatly facilitated. The stamping means may of course be arranged with any embodiment within the scope of the invention. Furthermore, the perforated pipes can be provided with filters which prevent soil particles from accompanying the liquid draining off through the pipe.

The invention shall thus not be regarded as restricted to the embodiments described above but may be varied within the scope of the accompanying claims.

I claim:

1. A method of compacting with the aid of vibrations a soil stratum consisting of one or more layers, comprising driving at least one vibration-transferring member, having a variable axial extension both before and in conjunction with vibration compaction, into the soil stratum, mounting a variable frequency vibrator on the vibration-transferring member to cause the latter during vibration of said vibrator to vary along its axial extension for activating surrounding earth stratum, monitoring soil oscillation amplitude on thus activating the soil stratum to provide signals having a frequency content which is a function of the earth stratum activated, analyzing the frequency content of said signals to determine the natural frequency of the earth stratum or one of its overtones, and continuously adjusting the frequency of the vibrator and the vibration-transferring member as a function of the determined natural frequency of the earth stratum or one of its overtones, said frequency varying with the wave velocity of the earth stratum.

2. Method as claimed in claim 1 wherein the axial extension of the vibration-transferring member is changed elastically.

3. Method as claimed in claim 1, wherein the axial extension before or during compaction is regulatably varied with relation to the stiffness of the soil stratum.

4. Method as claimed in claim 1, wherein liquid or other material can be led through the vibration-transferring member and out into surrounding earth strata.

5. Apparatus for compacting with the aid of vibrations a soil stratum consisting of one or more layers, and including at least one vibration-transferring member adapted to be driven into the soil stratum, and a vibration generating means operatively connected to the vibration-transferring member for transferring vibrations produced by said vibration generating means to said vibration transferring member and including at least one sensor, an analyzer and a control means for continuously adjusting the frequency of the vibration-transferring member for agreement with the natural frequency of the soil stratum or one of its overtones, said frequency varying with the wave of velocity of the soil stratum, said vibration-transferring member being variable along its axial extension both before and in conjunction with vibration compaction.

6. Apparatus as claimed in claim 5, wherein the vibration-transferring member is variably elastic.

7. Apparatus as claimed in claim 5, wherein the vibration-transferring member comprises a pipe or rod-shaped means.

8. Apparatus as claimed in claim 7, wherein the means is helically formed.

9. Apparatus as claimed in claim 7, wherein the means comprises a plurality of sections.

10. Apparatus as claimed in claim 7, wherein the vibration-transferring member is a pipe-shaped means, characterized in that the cylindrical surface of the means has openings.

11. Apparatus as claimed in claim 10, wherein each opening is covered by a filter.

12. Apparatus as claimed in claim 7, wherein the vibration-transferring member is provided at its lower end with a stamping means.

13. Apparatus as claimed in claim 9, characterized in that mutually adjacent sections of the means are separated by a resilient element.

14. Method according to claim 1, wherein the axial extension of the vibration-transferring member is changed resiliently.

15. Method according to claim 1, wherein the axial extension of the vibration-transferring member is changed telescopically.

16. Method according to claim 1, wherein liquid or other material can be led from surrounding earth strata through the vibration-transferring member for injecting draining liquid or other material.

17. Apparatus as claimed in claim 5, wherein the vibration-transferring member is resilient.

18. Apparatus as claimed in claim 5, wherein the vibration-transferring member is of telescopic construction.

* * * * *

UNITED STATES PATENT AND TRADEMARK OFFICE

CERTIFICATE OF CORRECTION

PATENT NO. : 4,699,546

DATED : October 13, 1987

INVENTOR(S) : Karl Rainer Massarsch

It is certified that error appears in the above-identified patent and that said Letters Patent is hereby corrected as shown below:

At item [73] on the front face of the patent "S.A. Compagnie Internationale" should read --S.A. Compagnie Internationale Des Pieux Armes Frankignoul, d/b/a, Franki International, Franki--

Signed and Sealed this

Sixth Day of September, 1988

*Attest:*

*Attesting Officer*

DONALD J. QUIGG

*Commissioner of Patents and Trademarks*